US006941677B2

(12) United States Patent
Adrian

(10) Patent No.: US 6,941,677 B2
(45) Date of Patent: Sep. 13, 2005

(54) PORTABLE AIR HEATING SYSTEM

(75) Inventor: Trevor Adrian, Park City, UT (US)

(73) Assignee: Taps, LLC, Park City, UT (US)

( * ) Notice: Subject to any disclaimer, the term of this patent is extended or adjusted under 35 U.S.C. 154(b) by 0 days.

(21) Appl. No.: 10/215,918

(22) Filed: Aug. 9, 2002

(65) Prior Publication Data

US 2003/0056390 A1 Mar. 27, 2003

Related U.S. Application Data

(60) Provisional application No. 60/311,647, filed on Aug. 10, 2001.

(51) Int. Cl.[7] ..... F26B 19/00

(52) U.S. Cl. ..... 34/227; 34/79; 126/110 B; 126/116 B

(58) Field of Search ..... 126/110 B, 110 D, 126/116 B, 116 R, 109; 34/79, 104, 202, 218, 227; 165/64, 66, 126, 157

(56) References Cited

U.S. PATENT DOCUMENTS

| | | | | | |
|---|---|---|---|---|---|
| 2,716,975 A | * | 9/1955 | Johnston | 126/110 R |
| 2,811,962 A | * | 11/1957 | Peisue et al. | 126/110 B |
| 3,036,382 A | * | 5/1962 | Sholton, Jr. | 34/549 |
| 3,435,817 A | * | 4/1969 | Ott | 126/110 R |
| 3,451,663 A | | 6/1969 | Hille | |
| 3,815,572 A | * | 6/1974 | Wolfe | 126/59 |
| 3,916,870 A | * | 11/1975 | Beavers | 126/110 B |
| 4,000,749 A | | 1/1977 | Busco | |
| 4,268,248 A | | 5/1981 | Wilbur et al. | |
| 4,883,512 A | | 11/1989 | Griffis | |
| 5,121,739 A | | 6/1992 | Barker | |
| 5,331,991 A | | 7/1994 | Nilsson | |

* cited by examiner

*Primary Examiner*—Denise L. Esquivel
*Assistant Examiner*—Kathryn S. O'Malley
(74) *Attorney, Agent, or Firm*—Workman Nydegger

(57) ABSTRACT

A portable air heating system for use in remote areas is disclosed. The portable air heating system provides a stream heated air for use in heating the interior of a structure, such as a tent or camp trailer. The heating system generally comprises an air transfer assembly for providing a flow of air through the system, a fuel burner assembly for providing heat by combustion, and a heat transfer housing for safely transferring the heat produced by the fuel burner assembly to the air flowing through the transfer assembly. The burner assembly and the heat transfer housing are both positioned outside the area being heated. Further, the exhaust gases are completely isolated from the air heated by the system, thereby virtually eliminating the likelihood of asphyxiation by the exhaust gases from the burner. The present heating system is also highly portable and simple to use, thereby providing an efficient mechanism for providing heat where more traditional heating apparatus are not readily available.

27 Claims, 9 Drawing Sheets

24B
24
24A 24A
24B
24

22B
22

26C
28
26B
22A
26A
26
26D
26E

PORTABLE AIR HEATING SYSTEM

CROSS-REFERENCE TO RELATED APPLICATIONS

This application claims the benefit of U.S. Provisional Application No. 60/311,647, filed Aug. 10, 2001 and entitled "Portable Air Heating System," which is hereby incorporated by reference.

BACKGROUND OF THE INVENTION

1. Field of the Invention

The present invention generally relates to heating devices. More particularly, the present invention relates to a portable air heating system for use in remote areas.

2. Description of Related Art

The popularity of outdoor recreation in the United States has grown tremendously in recent years. An ever increasing number of outdoor activities have become more accessible to a greater number of people, resulting in a greater proportion of the general population spending more time in less developed and remote areas of the country. Examples of such recreational activities include hiking, biking, camping, hunting, rock climbing, and mountain climbing.

This increased interest and participation in outdoor recreation has increased the demand for products that provide some of the comforts of modem living. For instance, portable tents of many shapes and sizes have been manufactured to provide privacy and shelter during camping and overnight excursions to remote outdoor areas. Additionally, products such as folding chairs, compact cooking apparatus, backpacks, and portable food storage devices, such as coolers, enable persons to enjoy activities in remote areas while still enjoying some of the necessities or comforts of modem life. As a result, people are seeking more of the modem comforts even during their recreational activities in the remote areas.

A common concern for persons spending time in the outdoors relates to keeping warm. Without the benefit of temperature-regulated buildings or structures, a person in a remote area is often subject to extreme temperature variations. For example, mountainous areas are a popular destination for campers, hikers, bikers, climbers, and hunters. Yet, because of their high elevation, these areas often experience much lower temperatures than are comfortable, especially at night.

Portable heat sources are often used to help protect oneself from the low temperatures frequently encountered while in the outdoors. One example of such a portable heat source is a small packet containing substances that, when activated by pressure, produce an exothermic chemical reaction, thereby providing heat for a limited amount of time. Once activated, the packet can be placed close to the body part desired to be warmed, such as the hands, feet, or face, thereby providing relief from the cold. Despite their convenience, such heat packets are of limited value because of their small size and limited output of heat. Also, these packets cannot heat an enclosed space, such as the interior of a structure like a tent, tent trailer, camper or camp trailer.

Portable direct air combustion heaters have also been utilized for purposes of providing heat in the outdoors where other sources of heat, such as electricity, are unavailable. These combustion heaters bum a fuel, such as gasoline or propane, to produce relatively large quantities of heat. These direct air combustion heaters are commonly used in the outdoors to heat enclosed areas, such as the interior of a tent, tent trailer, camper, or camp trailer. Notwithstanding their ability to heat an enclosed interior space, direct air combustion heaters can pose serious safety hazards. In particular, these heaters bum a mixture of fuel and air in a combustion reaction to produce heat. This reaction also creates a byproduct of potentially dangerous gases, such as carbon monoxide and carbon dioxide. These exhaust gases are potentially very dangerous and in some cases deadly because they may replace the oxygen within an enclosed environment, such as a tent, tent trailer, camper, or camp trailer, and potentially asphyxiate or at least make the persons therein ill. Much care, therefore, must be taken with such heaters to provide proper ventilation to avoid illness and/or asphyxiation by the exhaust gases. Additionally, placing direct air combustion heaters inside the tent or camp trailer poses a fire hazard due to the flammable materials often stored inside such structures, or from which such structures are manufactured.

BRIEF SUMMARY OF THE INVENTION

In light of the above-described problems associated with conventional portable heaters, a need exists for a reliable and highly portable heat producing system that efficiently and safely provides relatively large quantities of heat to persons and structures in remote areas, such as the outdoors. Moreover, a need exists for a portable heater that is easy to assemble and disassemble, and can produce heat safely without creating elevated levels of potentially dangerous and even deadly exhaust gases, including carbon monoxide, within an enclosed space, such as a tent, tent trailer, camper, or camp trailer.

In accordance with the present invention, as embodied and broadly described herein, the foregoing needs are met by a portable air heating system. The portable air heating system is particularly useful in remote areas where access to more conventional methods for providing heat are unavailable, though the heating system may also be utilized in a variety of other locations as well. Advantageously, the air heated by the heating system is isolated from combustion-produced exhaust gases, allowing the air within an enclosed space, such as a tent, to be heated safely.

One aspect of the portable air heating system is an air transfer assembly that both draws air into the system and expels air out of the system. The air transfer assembly comprises an air intake conduit and air outlet conduit, both of which have one end connected to a heat transfer housing. A motorized fan disposed within the air intake conduit draws air into the air intake conduit through the free end, and expels the air through passages defined in the heat transfer housing and through the air outlet conduit. The motorized fan is powered by an electrical source, such as a battery. Advantageously, the air transfer system allows the user to draw air from either inside or outside of the location desired to be heated. For example, the air transfer assembly may be used to bring fresh outside air into a tent, or it may be used to recirculate and/or reheat the air already inside the tent. The air transfer assembly is also used to direct the heated air into the tent or other structure.

Another aspect of the portable air heating system is the heat transfer housing which includes one or more exterior walls defining the perimeter of the housing, and a plurality of passages or heat transfer tubes extending from one side of the housing to the other side of the housing. The heat transfer tubes, which transport the air to be heated through the heat transfer housing, advantageously isolate the air to be heated from the harmful exhaust gases produced by burning fuel during operation of the air heating system. Additionally, the heat transfer tubes may be constructed of copper, and are arranged in a pattern that maximizes their exposure to heat produced by a burner during operation of the air heating system. Thus, the heat transfer tubes are configured to absorb the heat produced by the burner and transfer it to the air flowing through the heat transfer tubes. The heat transfer housing preferably includes one or more heat deflectors that assist in directing the heat produced by the burner toward the heat transfer tubes. The heat deflectors also increase the safety of the system by reflecting the heat away from the exterior walls of the heat transfer housing so that the walls are not the primary point of heat contact.

Yet another aspect of the portable air heating system is a fuel burner assembly. The fuel burner assembly includes the fuel burner, located directly below the heat transfer tubes and within the exterior walls of the heat transfer housing, a fuel supply tube connected to the burner, and a connector for connecting the fuel supply tube to a fuel source, such as a liquid propane tank. The connector also includes a valve for controlling the flow of fuel to the burner.

To operate the portable air heating system, the system is first securely placed on the ground or other stable location outside the structure to be heated, such as a tent. The free end of the air intake conduit is also placed outside the structure to be heated, where it has access to fresh, ambient air. Alternatively, the free end of the air intake conduit may be positioned inside the structure to be heated to recirculate air from inside the structure through the heat transfer housing circulate. Recirculating the air inside the structure allows the structure to be heated more quickly and to a higher temperature. The free end of the air outlet conduit is disposed within the structure to supply heated air to the structure.

Next, the fuel supplied to the burner through the fuel supply tube is ignited to produce an exothermic combustive reaction within the heat transfer housing. At the same time, the motorized fan is turned on to produce a flow of air through the air intake conduit, the heat transfer tubes, and the air outlet conduit. The burning fuel heats the heat transfer tubes, which are preferably highly thermally conductive so as to absorb a significant portion of the heat produced by the burner. This heat warms the air passing through the heat transfer tubes. The heated air then is directed through the outlet conduit where it exits the system and enters the structure, thereby heating the interior of the structure.

The air flowing through the air transfer assembly does not mix with the exhaust gases. That is, the heated air at no point comes into contact with the potentially dangerous gases, such as carbon monoxide, produced as a byproduct of the fuel combustion. These exhaust gases, which are produced in the heat transfer housing located exterior to the tent, pass harmlessly out of the heat transfer housing and into the atmosphere during operation of the heating system. Thus, the tent or other structure is safely isolated from the harmful exhaust gases, thereby safely heating the interior of the structure to provide a comfortable environment for persons therein.

The portable heating system may also be employed as a body warmer by directing the flow of heated air exiting the air outlet conduit over one's body. In yet another aspect, a portion of the heat transfer housing may be used as a heating surface that can be used, for example to warm food or even to warm or dry clothing.

In addition to safely heating enclosed areas or one's person, the portable air heating system is also compact and portable, thereby allowing it to be easily transported to remote areas. Due to its simple design, the system is also easily set up for use in a minimum amount of time.

These and other features of the present invention will become more fully apparent from the following description and appended claims.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made to the figures where various structures will be provided with reference number designations. It is understood that the drawings are diagrammatic and schematic representations of possible embodiments of the invention, and are not intended to limit the scope of the present invention nor are they necessarily drawn to scale. Further, one skilled in the art will appreciate that terms such as top, bottom, upper, and lower as used herein are merely words used to describe the accompanying figures, and are not meant to limit the scope of the present invention in any way.

FIGS. 1–9 depict various elements of a self-contained, portable air heating system. Advantageously, the inventive portable heating system provides a reliable source of heated air to an enclosed structure, such as a tent or camp trailer, while eliminating the introduction of potentially dangerous exhaust gases, such as carbon monoxide, into the enclosed structure. In addition, the air heating system is portable and simple to use, which is particularly important when the user is traveling to remote areas.

Figure 1:
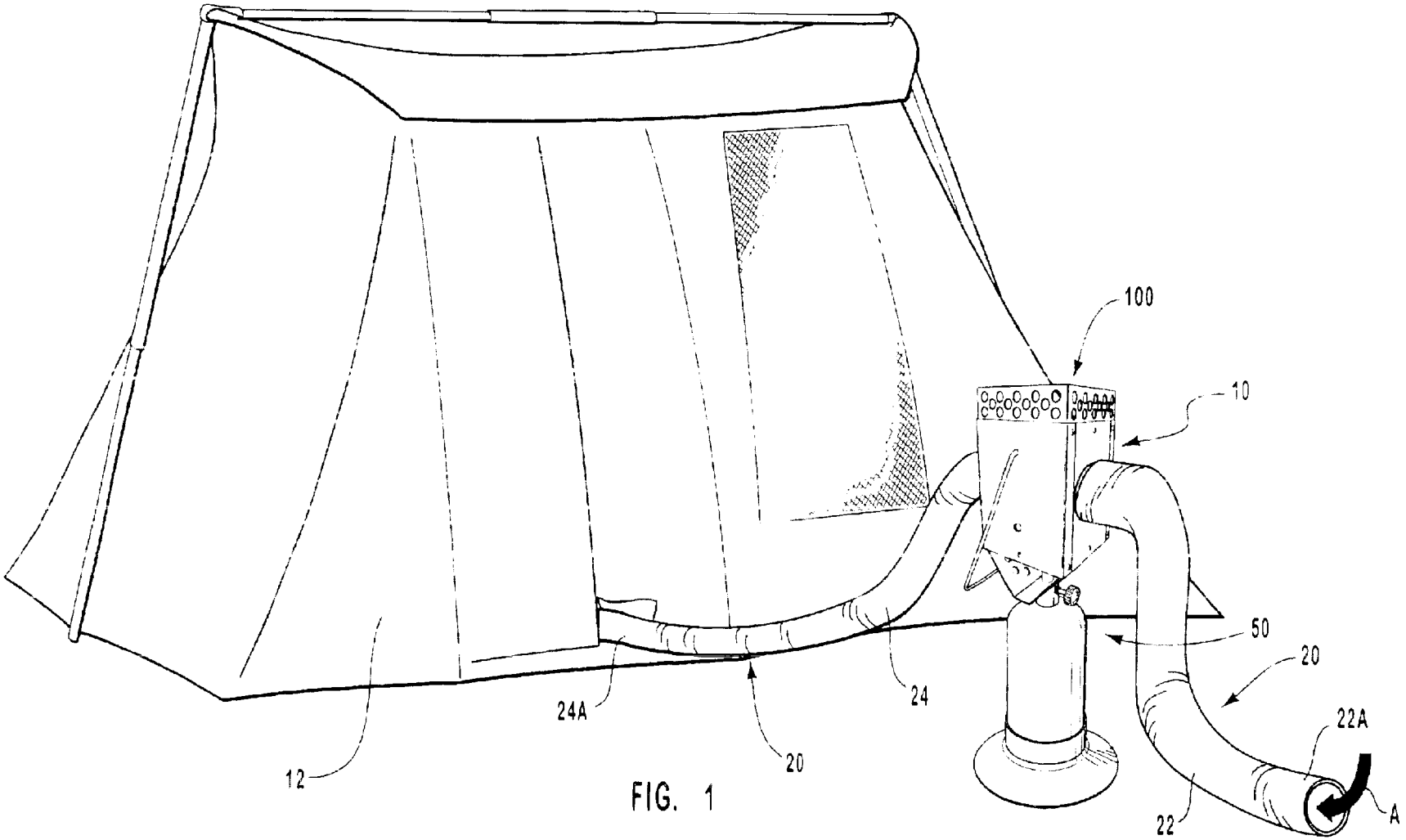
FIG. 1 is a perspective view of one embodiment a portable air heating system and illustrates one example of using the heating system with a tent structure.

FIG. 1 illustrates one embodiment of a portable air heating system 10 used for heating an enclosed structure 12, such as a tent, tent trailer, camper or camper trailer. FIG. 1 depicts one possible arrangement of portable air heating system 10 being used to heat the interior of tent 12. The discussion herein refers to use of portable air heating system 10 with a tent. It will be appreciated by one skilled in the art that this discussion and description of use is equally applicable to other types of enclosed structures, including but not limited to tent trailers, campers, camper trailers and the like.

As can be seen from FIG. 1, portable air heating system 10 is placed near, but not in, tent 12. Air heating system 10 is configured such that the air heated by air heating system 10 and blown into tent 12 is isolated from the combustion portion of air heating system 10 producing the heat. In particular, the air heated by air heating system 10 is always kept isolated from the exhaust gases, which are vented by air heating system 10 into the atmosphere exterior to the tent. Thus, air heating system 10 safely heats the interior of tent 12 because it does not introduce harmful exhaust gases, including but not limited to carbon monoxide, into tent 12. In addition to reliably and safely providing heated air to a person or the interior of a structure, air heating system 10 may also simultaneously be used to heat things such as food, drinks, small articles of clothing, etc., by placing such things on top of heating system 10, as will be discussed in further detail later on.

Figure 2:
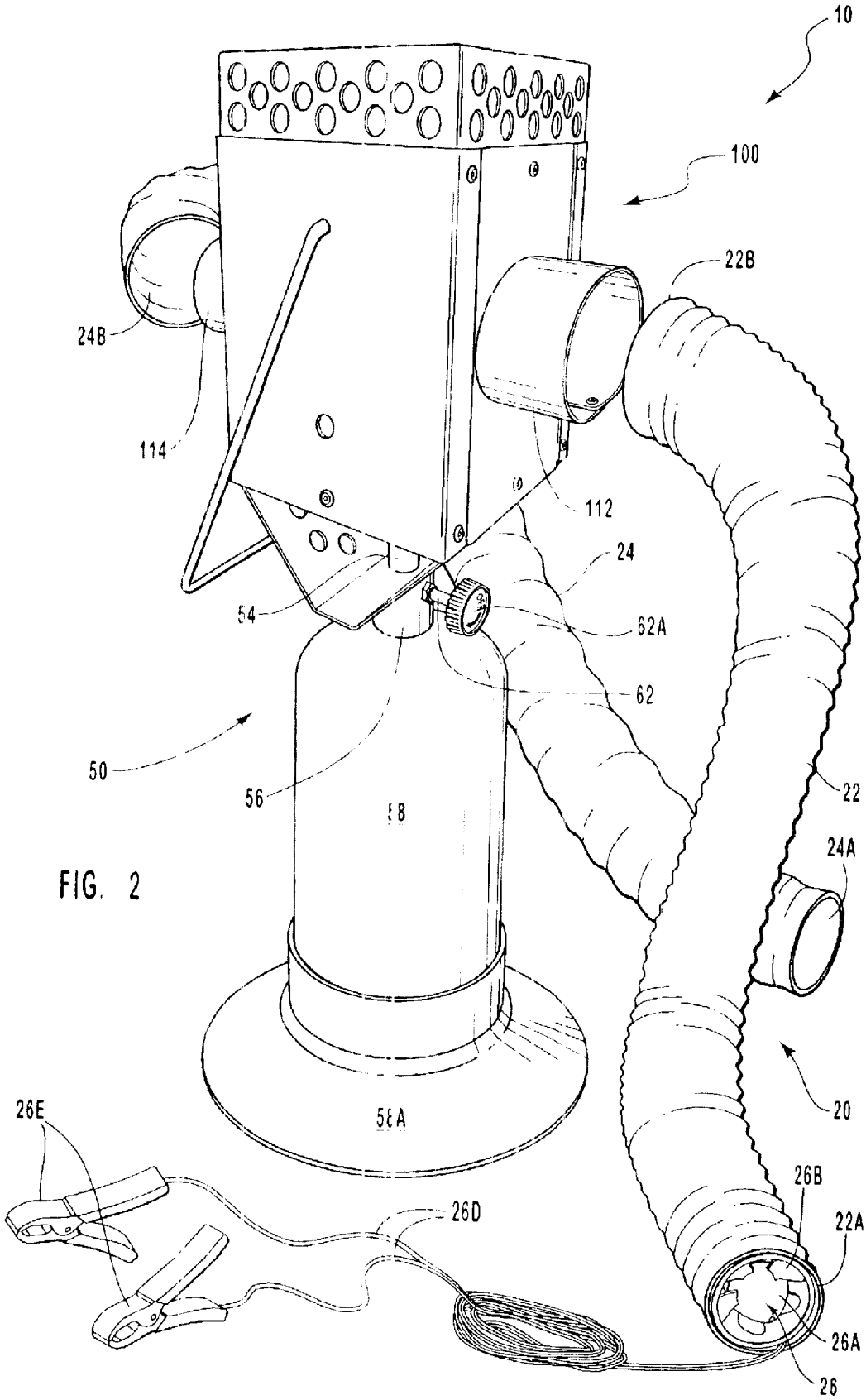
FIG. 2 is a perspective, partially exploded view of the portable air heating system shown in FIG. 1 in further detail.

Referring to FIGS. 1 and 2, which show one embodiment of portable air heating system 10, portable air heating system 10 comprises an air transfer assembly 20, a fuel burner assembly 50, and a heat transfer housing 100. During operation of air heating system 10, which is explained in further detail below, the above components operate in unison to provide a safe supply of heated air for use as desired by the user.

Figures 3A, 3B, 3C:
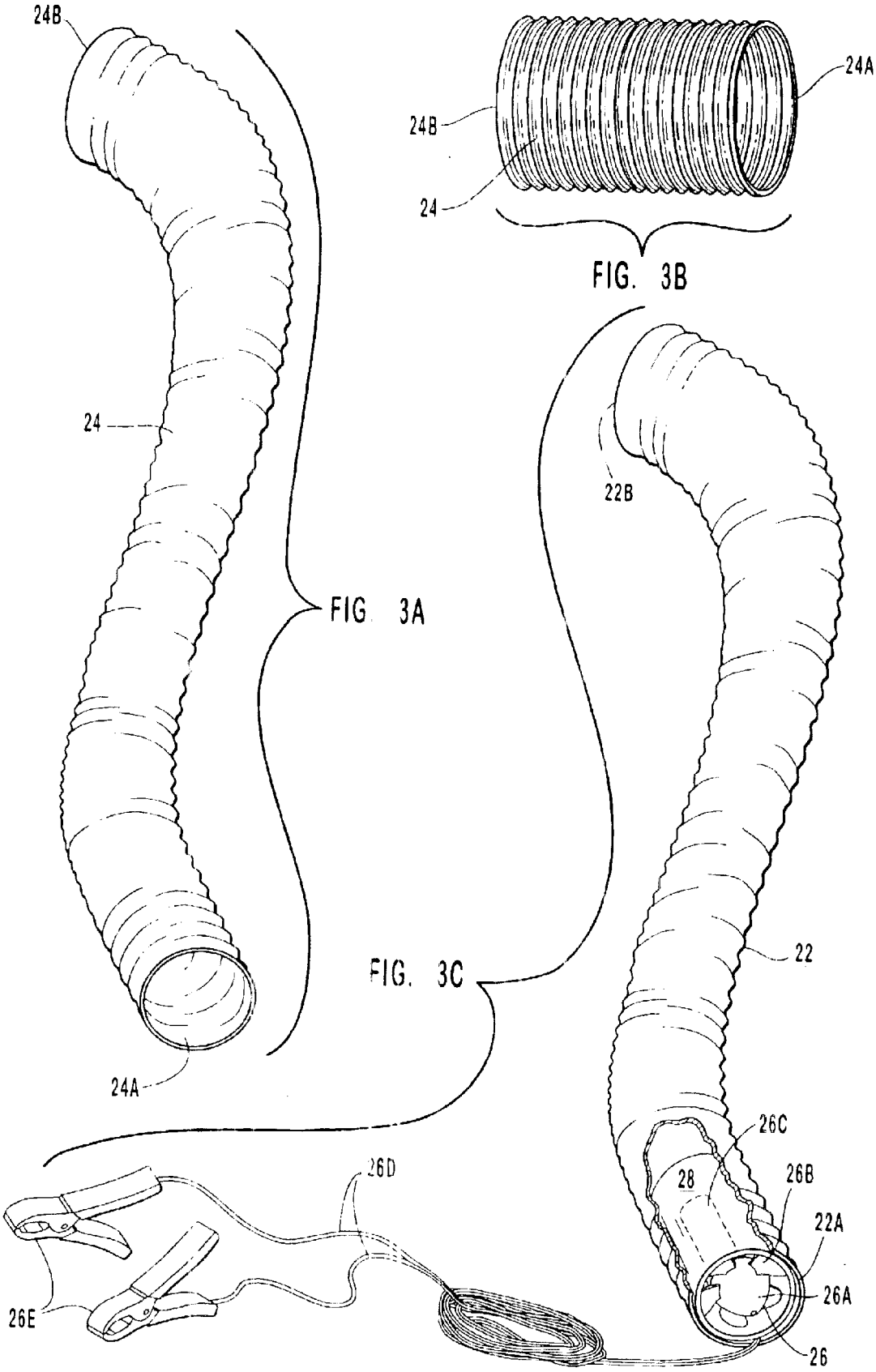
FIG. 3A is a perspective-view of one embodiment of an air outlet conduit of the portable air heating system shown in FIG. 2 in an expanded position.
FIG. 3B is a perspective view of the air outlet conduit shown in FIG. 3A illustrated in a collapsed position.
FIG. 3C is a perspective break away view of one embodiment of an air intake conduit of the portable air heating system shown in FIG. 2, illustrating the air intake conduit in an expanded position.

As illustrated in FIG. 1, in the depicted arrangement of air heating system 10, air transfer assembly 20 directs fresh, ambient air into and through the heat transfer housing 100 and into tent 12. In one possible embodiment depicted in FIGS. 1 and 2, air transfer assembly 20 includes a hollow air intake conduit 22 having open first and second ends 22A and 22B, respectively, and a hollow air outlet conduit 24 having open first and second ends 24A and 24B, respectively. Second ends 22B and 24B of air intake and air outlet conduits 22 and 24, respectively, are removably attached to heat transfer housing 100 to direct a flow of air through heat transfer housing 100. It will be appreciated by one skilled in the art that while FIGS. 3A and 3B depict air outlet conduit 24, the discussion related thereto substantially applies to air intake conduit 22. In addition, it will also be appreciated by one skilled in the art that while FIGS. 3A and 3C show air intake conduit 22 and air outlet conduit 24 having substantially the same configuration and length, it is not required. It is contemplated that air intake conduit 22 and air outlet conduit 24 could have different configurations and/or lengths.

Returning to FIG. 1, air intake conduit 22 draws air, either ambient air, into air heating system 10, and air outlet conduit 24 directs heated air into structure 12. FIG. 1 depicts one possible way of arranging air intake conduit 22 and air outlet conduit 24. As depicted, first end 22A of air intake conduit 22 is positioned outside of tent 12 and draws in ambient air as illustrated by arrow A. Alternatively, it is contemplated herein that in some cases it might be desired to utilize the configuration depicted in FIG. 8, where first end 22A of air intake conduit 22 draws air from the inside of tent or structure 12 into heat transfer housing 100. This heated air is then blown out air outlet conduit 24 back into tent 12. The effect of this arrangement is recirculating and reheating the air within tent 12.

As depicted in FIGS. 2, 3A, 3B and 3C, air intake and air outlet conduits 22 and 24, respectively, are preferably flexible to offer maximum versatility in positioning air intake and outlet conduits 22 and 24, respectively, in the desired locations relative to tent 12 and heat transfer housing 100. In one embodiment, air intake conduit 22, and particularly air outlet conduit 24, may optionally have a heat reflective inner surface to help retain the heat of the air therein. Additionally, air intake and air outlet conduits 22 and 24, respectively, may also optionally include a helically wound metallic wire to provide resilient support for the conduits. Advantageously, conduits constructed in this manner are strong enough to maintain their substantially cylindrical shape while under some stress, yet are lightweight and collapsible, as depicted in FIG. 3B, for easy storage and transport. Further, air intake conduit 22 and air outlet conduit 24 are preferably expandable to any suitable lengths necessary to enable portable air heating system 10 to function properly and safely. For example, in one embodiment, air intake and air outlet conduits 22 and 24, respectively, are each approximately two to four feet long when extended to their preferred operating length, but the conduits may have any suitable length depending upon the intended use of air heating system 10. It will be appreciate by those skilled in the art that various other lengths of air intake conduit 22 and air outlet conduit 24 are capable of performing the function thereof. In addition, it will also be appreciated by one skilled in the art, that while one embodiment of air intake conduit 22 and air outlet conduit 24 depicted in FIGS. 2, 3A and 3C, have the same length, this is not required. Depending on the particular use for portable air heating system 10, it is contemplated that a particular configuration of air heating system 10, could utilize air intake conduit 22 and air outlet conduit 24 each having a different length. It will also be appreciated that while air intake and outlet conduits 22 and 24, respectively, are depicted as having a substantially cylindrical cross-section, they could have various other configurations and perform the function thereof.

As can be seen in FIG. 3C, in one embodiment air intake conduit 22 has a motorized fan 26 disposed within its inner volume. It will be appreciated that various types of motorized fans could be utilized in this device. In one possible embodiment illustrated in FIGS. 2 and 3C, motorized fan 26 directs air into the air intake conduit 22 and through air transfer assembly 20. In one embodiment, motorized fan 26 includes an impeller 26A having a plurality of blades 26B and a motor 26C (FIG. 3C). In one embodiment of motorized fan 26, illustrated in FIG. 3C, blades 26B are angled relative to the axis of rotation. It will be appreciated that blades 26B could have various other angular positions relative to the axis of rotation, including being perpendicular thereto. Motorized fan 26 is configured to include a power source. It will be appreciated that various types of power sources could be utilized for motorized fan 26, such as batteries or adaptors to connect motorized fan 26 to a separate power source such as a car battery.

In one possible embodiment, illustrated in FIGS. 2 and 3C, motorized fan 26 includes two electrical cable leads 26D that are in electrical communication with motor 26C. Electrical cable leads 26D may have any suitable length, such as by way of example and not limitation, approximately 12 feet, and are fitted with clamps 26E, allowing motor 26C of motorized fan 26 to be electrically connected to a car battery or similar power source. Motorized fan 26 may also include an on/off switch (not shown) to control the function of the fan during operation of portable air heating system 10.

In another embodiment, electrical cable leads 26D may be electrically connected to a 12 volt cigarette plug configured to cooperate with a car, boat, camper and the like. Alternatively, electrical cable leads 26D may be attached to a rechargeable battery or other suitable power source disposed near the heating system 10 for added convenience and portability. Preferably, motorized fan 26 is structurally supported by and housed in a sleeve 28 comprising thermoplastic or similar material that, in turn, is fixedly disposed within air intake conduit 22 near first end 22A thereof by conventional fastening devices (not shown), such as a coupler. It will be appreciated that although sleeve 28 is cylindrical as depicted in FIG. 3C, sleeve 28 could have various other configurations including square, oval, elliptical, rectangular or various combinations thereof as long as sleeve 28 is configured to be attached to air intake conduit 22.

It will also be appreciated that while motorized fan 26 is depicted as disposed within air intake conduit 22, motorized fan 26 could instead be attached to first end 22A of air intake conduit 22. Various other arrangements are capable of carrying out the intended function thereof. One skilled in the art will appreciate that motorized fan 26 may be disposed in other locations in portable air heating system 10 while still preserving its functionality. Likewise, motorized fan 26 may differ in size and configuration from that explicitly described herein. For example, a fan powered by solar energy could be disposed in air outlet conduit 24 in order to direct air through air heating system 10.

Figure 4:
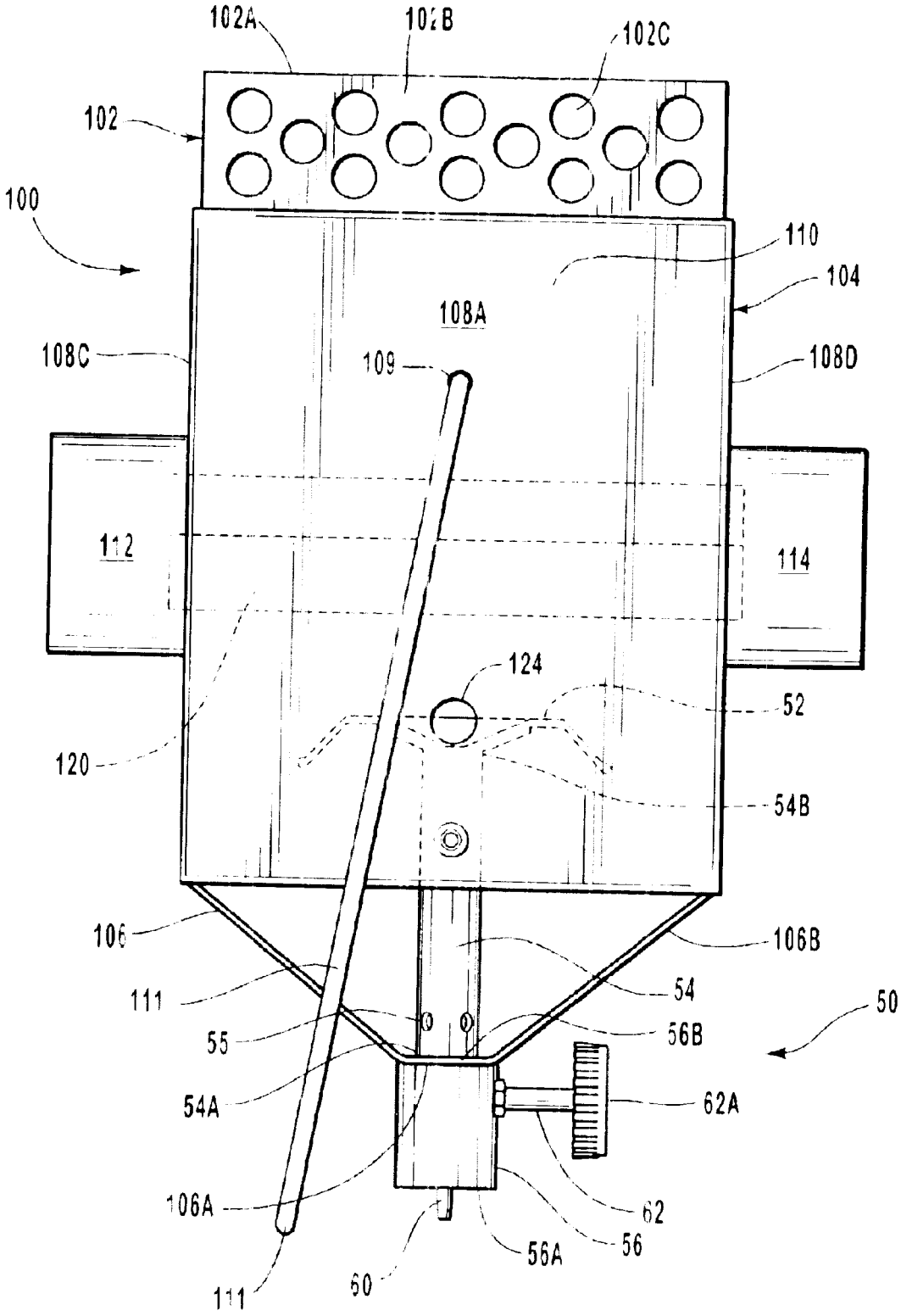
FIG. 4 is a front view of one embodiment of a portable air heating system shown in FIG. 1 with the fuel source, and the air intake and outlet conduits removed.

As depicted in FIG. 4, air heating system 10 includes fuel burner assembly 50, which combusts fuel to create heat in heat transfer housing 100. Fuel burner assembly 50 comprises a burner 52, a fuel supply tube 54, and a connector 56 that contains valve 62 therein. As illustrated in FIG. 2, connector 56 connects fuel burner assembly 50 to a fuel source 58, such as such as a conventional pressurized propane canister. Alternatively, other sizes and types of fuel sources may be utilized while still preserving the functionality of portable air heating system 10. For example, burner assembly 50 may be connected to a large five-gallon pressurized liquid propane tank, of the type commonly used with camp trailers, barbeques and the like.

More specifically, returning to FIG. 4, connector 56 connects fuel source 58 (see FIG. 2) to fuel supply tube 54. A needle 60 extends from a first end 56A of connector 56 into the outlet of fuel source 58 (not shown) to enable fuel from the fuel source to flow into connector 56. Valve 62 has a control knob 62A attached thereto and is disposed in connector 56 to control the flow of fuel through connector 56. Second end 56B of connector 56 is attached to first end 54A of fuel supply tube 54. Fuel supply tube 54 includes a plurality of vent holes 55 to allow air to be mixed with the fuel. Burner 52 is attached to the second end 54B of fuel supply tube 54 and includes a plurality of openings to release the fuel-air mixture where the flame will occur.

Figure 5:
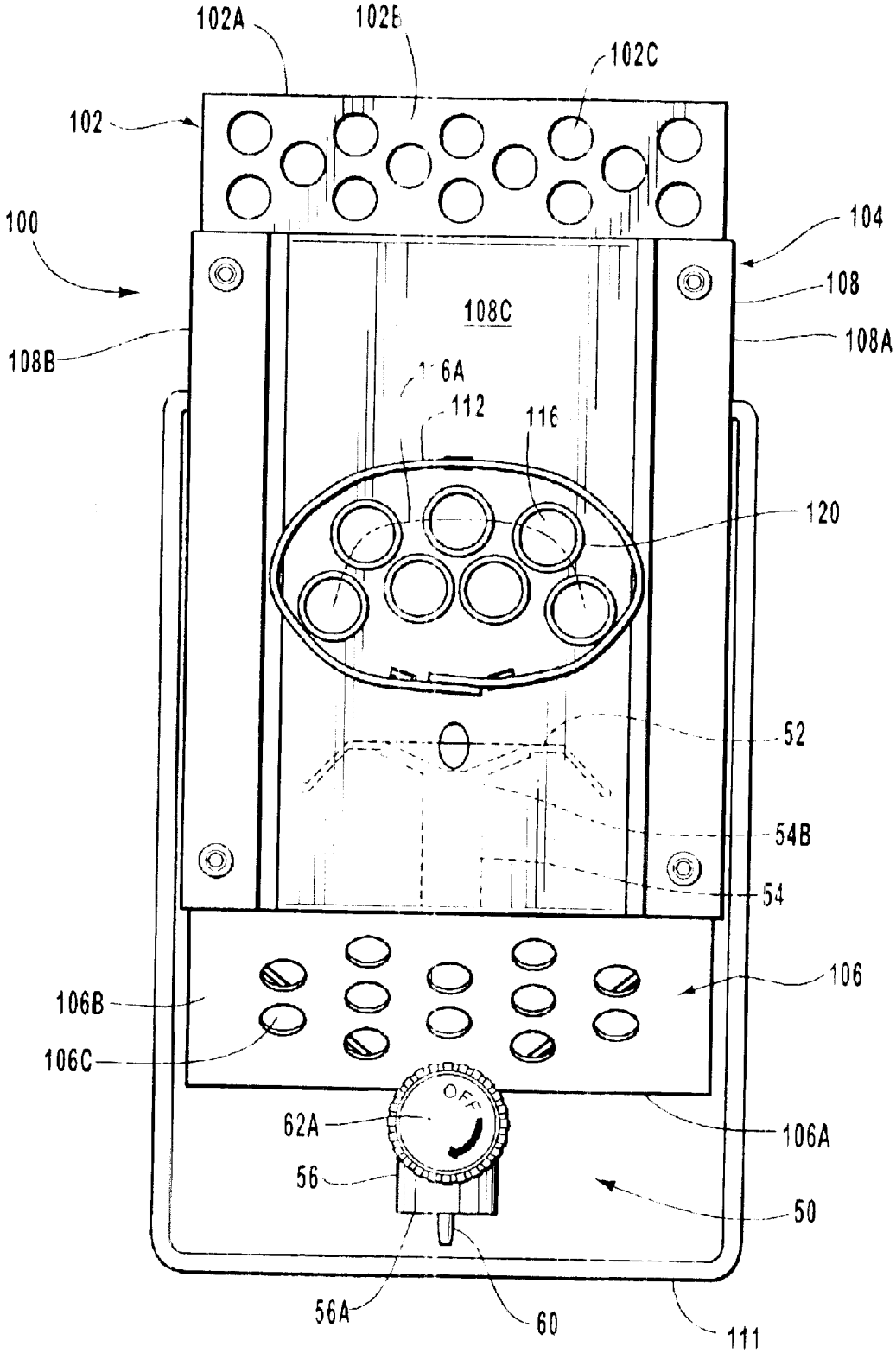
FIG. 5 is a side view of one embodiment of a portable air heating system shown in FIG. 4.

Reference now is made to FIGS. 4 and 5, which illustrate various features of heat transfer housing 100. Heat transfer housing 100 provides an enclosure in which heat produced by combustion of the fuel-air mixture is transferred to air flowing through heat transfer housing 100. Heat transfer housing 100 also directs the heat produced by the combustion towards the heat transfer tubes 120, which will be discussed in further detail below. Heat transfer housing 100 is preferably composed of a metallic material, such as steel, but one skilled in the art will appreciate that heat transfer housing 100 could be formed from other materials as well.

Heat transfer housing 100 includes a first end portion 102, a middle portion 104, and a second end portion 106. First end portion 102 may be integral with middle portion 104 or fixedly attached to middle portion 104 using any one of several attachment or fastening methods well known in the art, such as welding or mechanical fasteners. First end portion 102 includes a substantially planar top surface 102A and sides 102B. Top surface 102A, when heated by burner 52 during the operation of portable air heating system 10, may serve as a heating surface for warming things such as food, drinks, articles of clothing, etc. Sides 102B of first end portion 102 each include a plurality of openings 102C for venting exhaust gases from heat transfer housing 100. In one embodiment, sides 102B of first end portion 102 have approximately 14 openings 102C formed therein for venting combustion gases from heat transfer housing 100. It will be appreciated that various other numbers of openings could be formed in sides 102B of first end portion 102 to perform the function thereof. In addition, it will also be appreciated by one skilled in the art that openings 102C formed in sides 102B could have various other configurations other than round. Openings 102C could be square, rectangular, triangular, elliptical, octagonal, oval, or numerous other shapes or combinations thereof and still perform the function thereof. It will also be appreciated that openings 102C could also be formed in top surface 102A of first end portion 102.

In one possible embodiment, depicted in FIGS. 4 and 5, heat transfer housing 100 has a hollow, box-like configuration. It will be appreciated that heat transfer housing 100 may have various other configurations, including cylindrical, oval, elliptical, or the like. In one possible embodiment, by way of example and not limitation, heat transfer housing 100 could also be cylindrical.

Second end portion 106 of heat transfer housing 100 may also be integral to middle portion 104 or may be fixedly attached to middle portion 104 using any one of several attachment or fastening methods well known in the art, such as welding or mechanical fasteners. As depicted in FIG. 4, second end portion 106 of heat transfer housing 100 includes a substantially planar segment 106A supported a distance away from middle portion 104 of heat transfer housing 100 by two segments 106B that are divergingly angled with respect to one another. It will be appreciated that segments 106B in second end portion 106 could have different configurations, such as being flat, and perform the function thereof. It will be appreciated by one skilled in the art that second end portion 106 could have various other configurations and perform the function thereof. By way of example and not limitation, second end portion 106 could be an open box-like structure that is either formed of one sheet of material or multiple sheets attached together. Similarly, second end portion 106 could have the configuration of half a sphere with a flat spot at the center of the spherical surface remote from middle portion 104. It will be appreciated that numerous other configurations of second end portion 106 may be utilized to perform the function thereof.

In one embodiment depicted in FIG. 5, each angled segment 106B is attached at one end to substantially planar segment 106A and at the other end to middle portion 104. Each angled segment 106B includes a plurality of apertures 106C similar in size to those disposed on sides 102B of first end portion 102 to allow air to enter heat transfer housing 100. In one embodiment, the areas adjacent to and between the outer edges of angled segments 106B are open to allow additional air to enter heat transfer housing 100.

It will be appreciated that various other numbers of apertures 106C could be formed in segments 106B of second end portion 106 to perform the function thereof. In addition, it will also be appreciated by one skilled in the art that apertures 106C formed in segments 106B could have various other configurations than merely being round. These apertures 106C could be square, rectangular, triangular, elliptical, octagonal, oval, or numerous other shapes or combinations thereof and still perform the function thereof.

Returning to FIG. 4, second end portion 106 of heat transfer housing 100 is connected to and structurally supported by fuel burner assembly 50. In particular, one end of fuel supply tube 54 is inserted through a hole (not shown) in planar segment 106A of second end portion 106 such that planar segment 106A of second end portion 106 of heat transfer housing 100 is resting on second end 56B of connector 56. In this manner, connector 56 of fuel burner assembly 50 supports second end portion 106, which in turn supports the other components of heat transfer housing 100. One skilled in the art will appreciate that the heat transfer housing 100 and the fuel burner assembly 50 could also be connected in various other ways and by other suitable means.

Figure 6:
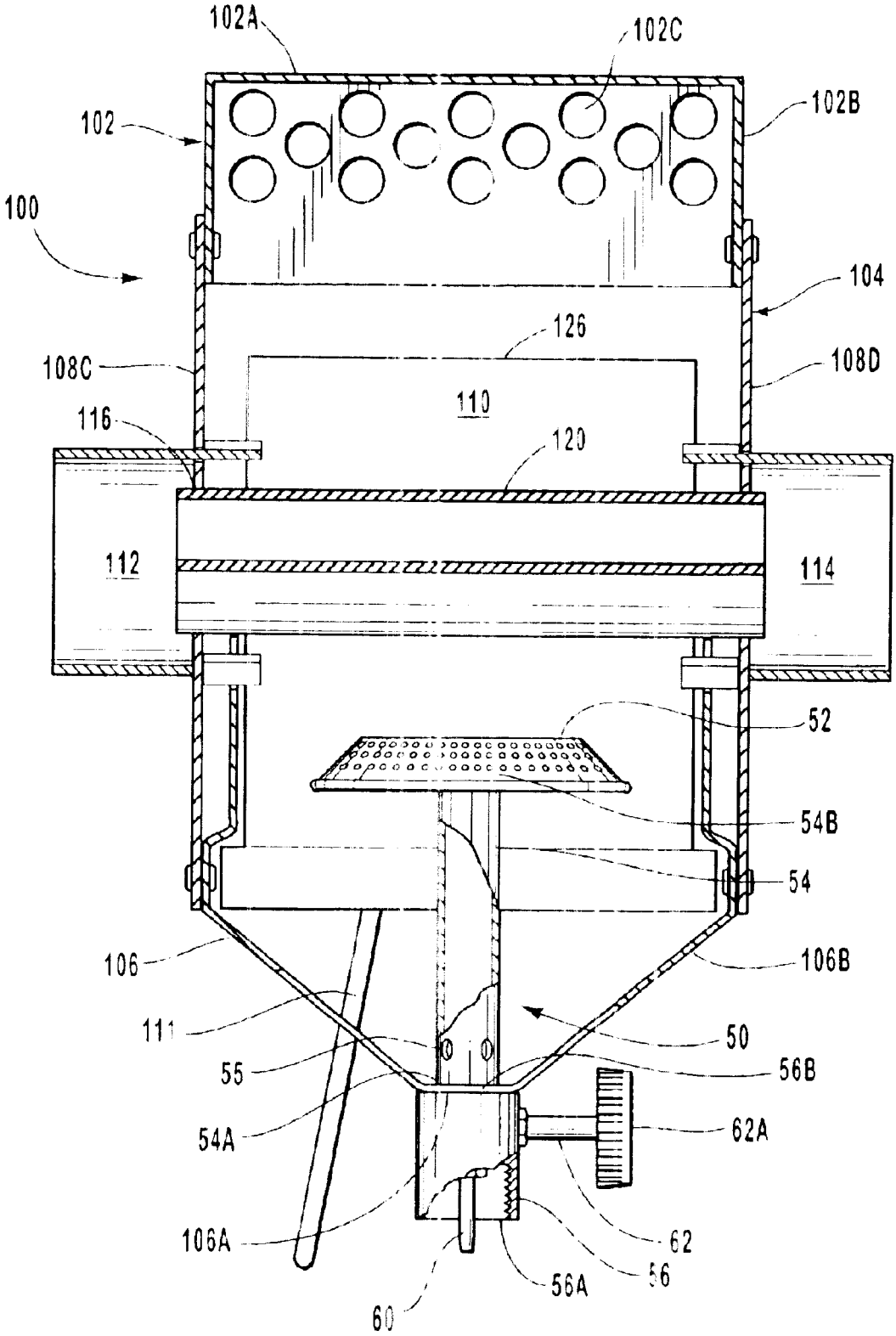
FIG. 6 is a cross sectional front view of one embodiment of a heat transfer housing and one embodiment of a burner assembly from the structure shown in FIG. 4.
Figure 7:
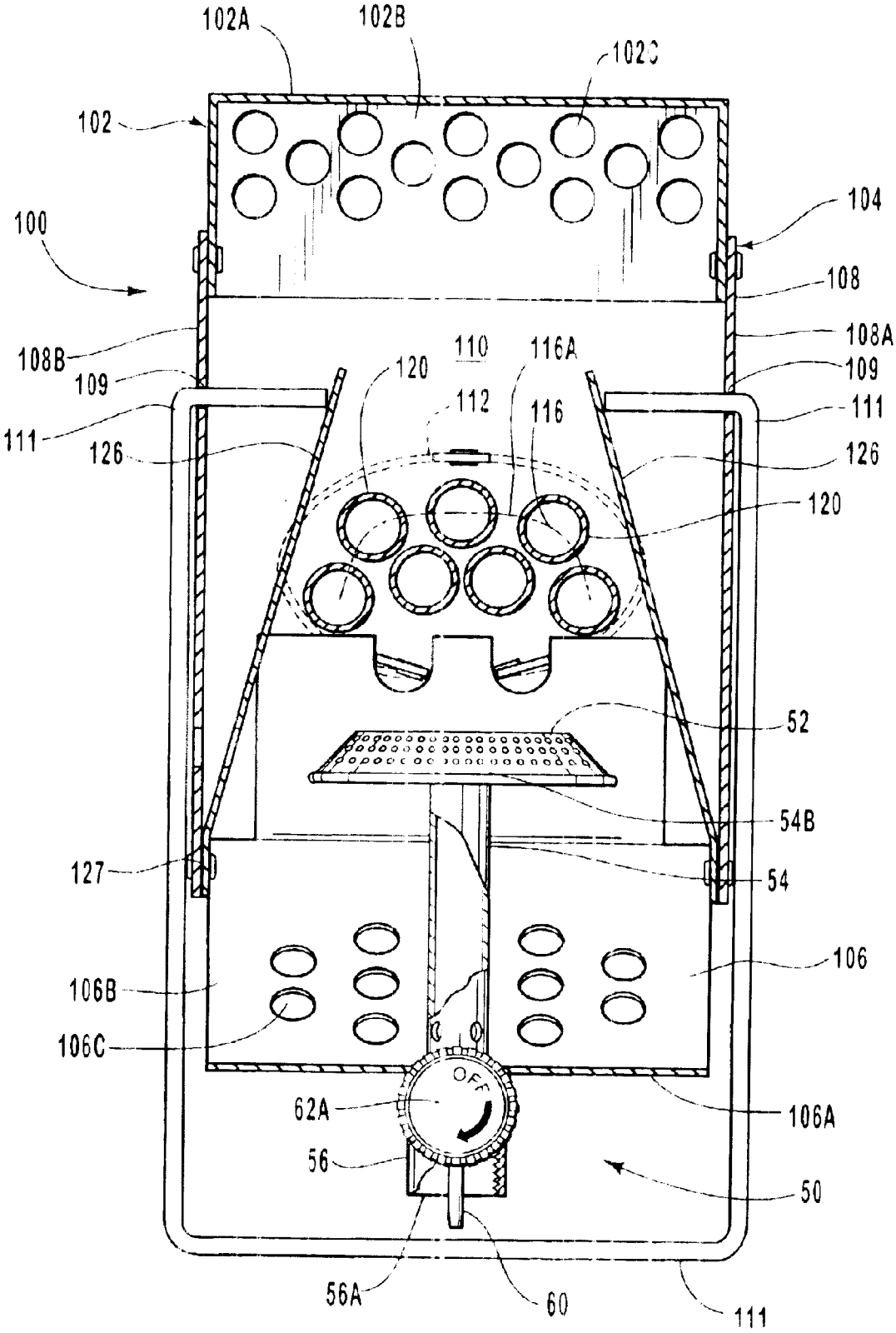
FIG. 7 is a cross sectional side view of the heat transfer housing and burner assembly shown in FIG. 6.

As illustrated in FIGS. 4–7, middle portion 104 of heat transfer housing 100 includes a housing portion 108 with a front side 108A, a back side 108B, a left side 108C, and a right side 108D. Sides 108A–108D together define an interior enclosure 110 for burning the fuel and transferring the heat to the air flowing through air transfer assembly 20. As depicted in FIGS. 4 and 7, middle portion 104 of heat transfer housing 100 has apertures 109 disposed on both the front side 108A and back side 108B configured to receive the ends of a handle 111. It will be appreciated that various numbers and configurations of apertures 109 can be used to perform the same function as long as they are configured to cooperate with handle 111.

Referring to FIGS. 4, 5, and 6, middle portion 104 also includes an intake sleeve 112 for receiving second end 22B of the air intake conduit 22 (see FIG. 2). Intake sleeve 112 is attached to left side 108C of the housing portion 108. Correspondingly, as illustrated in FIGS. 4 and 6, middle portion 104 also includes an outlet sleeve 114 attached to right side 108D of housing portion 108 for receiving second end 24B of air outlet conduit 24 (see FIG. 2). As best shown in FIGS. 5 and 6, sleeves 112 and 114 comprise hollow, rounded members composed of steel, aluminum, metal, or other suitable material. In one embodiment, sleeves 112 and 114 are rounded, generally elliptical shaped members. It will be appreciated that various other configurations of sleeves 112 and 114 can be used. By way of example and not limitation, sleeves 112 and 114 may be round, cylindrical, oval, square, rectangular and parabolic or combinations thereof.

Returning to FIGS. 1 and 2, when portable air heating system 10 is operational, second ends 22B and 24B of the air intake and air outlet conduits 22 and 24, respectively, are coupled to intake and outlet sleeves 112 and 114, respectively, in a slip fit arrangement. It is noted that a slight deformation of second ends 22B and 24B of air intake and air outlet conduits 22 and 24, respectively, may be necessary to accomplish the coupling thereof with the intake and outlet sleeves 112 and 114, respectively. Such a deformation is easily accomplished due to the flexible nature of the air intake and air outlet conduits 22 and 24, respectively. It will be appreciated that while in the embodiment of air heating system 10 that is depicted, air intake conduit 22 and intake sleeve 112 and air outlet conduit 24 and outlet sleeve 114, have slightly different configurations (cylindrical as compared to elliptical) these elements could have various other configurations that are designed to cooperate. The shape of air intake and air outlet conduits 22 and 24, respectively, and sleeves 112 and 114 are not of particular importance as long as the sleeves cooperate with the conduits. Alternatively, air intake and air outlet conduits 22 and 24, respectively, could be coupled with intake and outlet sleeves 112 and 114, respectively, by other fastening or connecting methods know in the art, including by way of example and not limitation, mechanical fasteners or tie downs.

Turning now to FIG. 5, within the intake sleeve 112 on left side 108C of housing portion 108, are a plurality of openings 116. Although not shown, there are a corresponding number of similarly configured openings 116 formed on right side 108D of housing portion 108 within outlet sleeve 114. Openings 116 are arranged in pairs on opposing left and right sides 108C and 108D of housing portion 108. In one embodiment, each opening 116 has a diameter of approximately 0.625 inches. It will be appreciated that various other sizes and configurations of openings could be used to perform the function thereof. In addition, in one embodiment depicted in FIG. 5, seven (7) openings are formed on each right and left sides 108C and 108D (not shown), respectively, of housing portion 108, thereby forming seven opposing pairs of openings. It will be appreciated by one skilled in the art, that various other numbers of openings and correspondingly pairs of openings 116 can be used to perform the function thereof.

In one embodiment, openings 116 are arranged on side 108C and, consequently, side 108D (not shown) of housing portion 108 with some of openings 116 being in an arc-like formation indicated by line 116A. Other openings 116 are positioned around the arc-like arrangement. In one embodiment depicted in FIG. 5, by way of example and not limitation, side 108C has five openings 116 in the arc-like arrangement. As shown, in this particular embodiment, two additional openings 116 are placed under the arc-like arrangement. It will be appreciated that various other arrangements of openings 116 are capable of performing the function thereof. The purpose for such an arrangement of openings 116 will be discussed in further detail below. It will be appreciated that the specific sizes and configurations of the openings 116 as described herein comprise one embodiment of the air heating system 10, but holes having other sizes, shapes and/or collective patterns may also be used depending, for example, upon the intended use of the heating system 10. It will be appreciated that various other numbers and configurations of openings 116 may be used to perform the function thereof. In addition, it will be appreciated that openings 116 may have various dimensions, and that all of openings 116 do not have to be the same size. Likewise, it will be appreciated that various other arrangements of openings 116 may be utilized to perform the function thereof.

Referring now to FIGS. 6 and 7, which depict a cross section of one embodiment of heat transfer housing 100 and one embodiment of fuel burner assembly 50 of the air heating system 10, heating system 10 includes an isolating means for isolating the air being heated from the exhaust gases. The isolating means comprises structure providing a conduit between air intake conduit 22 (not shown) to air outlet conduit 24 (not shown). The structure which performs the function of the isolating means isolates the air from the exhaust gases produced by burner 50 as the air flows from intake conduit 22 to outlet conduit 24. One example of structure which is capable of performing the function of such an isolating means for isolating the air being heated from the exhaust gases is heat transfer housing 100 which comprises housing portion 108 and heat transfer tubes or members 120.

As illustrated, heat transfer tubes 120 extend between each of the pairs of opposing openings 116. Each heat transfer tube 120 absorbs heat emitted by burner 52 during combustion of the fuel, transferring the heat to air flowing through heat transfer tubes 120. In one embodiment, heat transfer tubes 120 are composed of copper and are configured to connect opposing holes 116 in the side walls 108C and 108D of housing portion 108. It will be appreciated that heat transfer tubes 120 could be composed of other materials that are capable of absorbing the heat emitted by burner 52 and transferring the same to the air flowing through heat transfer tube 120.

In one embodiment, each heat transfer tube 120 is sufficiently long to allow each heat transfer tube 120 to extend from one opening 116 on left side 108C of housing portion 108 to the opposing opening 116 on right side 108D of housing portion 108. In one embodiment, the distance between opposing sides 108C and 108D is approximately 5.2 inches. It will be appreciated that various other lengths of heat transfer tubes 120 may be used as long as each heat transfer tube 120 is configured to cooperate with opposing openings 116, and isolates the air being heated from the harmful exhaust gases. It will be appreciated that although heat transfer tube 120 is illustrated as being a hollow round member, heat transfer tube 120 could have various other shapes or configurations as long as it is hollow. By way of example and not limitation, heat transfer tube 120 could be oval, elliptical, square, and rectangular or the like and any combination thereof as long as it is a hollow member.

Another possible embodiment of an isolating means for isolating the air being heated from the exhaust gas is a single tubular member providing a fluid connection from air intake conduit 22 through heat transfer housing 100 to air outlet conduit 24. By way of example and not limitation sleeves 112 and 114 could be one tubular member extending through heat transfer housing 100. Another possible embodiment of such an isolating means comprises one or more tubes providing a fluid connection from air intake conduit 22 through heat transfer housing 100 to air outlet conduit 24, wherein the tubes comprise multiple vertical or horizontal dividers to maximize the length of the pathway through heat transfer housing 100, and to maximize the surface area of the tubes in contact with the air flowing therethrough.

In one embodiment illustrated in FIGS. 5 and 7, the ends of each heat transfer tube 120 are optionally outwardly flared after insertion in the opposing pair of openings 116 formed in housing portion 108 to secure each heat transfer tube 120 in the desired location and to facilitate the flow of air through heat transfer tubes 120. The diameter of each heat transfer tube 120 is such that the fit between the outer diameter of the tube and the perimeter of the corresponding openings 116 are relatively tight, so as to prevent the harmful exhaust gases from contaminating the air being heated. One skilled in the art will appreciate that heat transfer tubes 120 may have other shapes and sizes that are suitable for the intended use of air heating system 10.

As illustrated in FIG. 7, burner 52 is located within heat transfer chamber 110, defined by housing portion 108, and is proximate to heat transfer tubes 120. A burner access hole 124 (see FIG. 4) is defined on either or both front or back side 108A or 108B of housing portion 108 for allowing a user to insert a match to light burner 52 to initiate operation of heating system 10. Alternatively, one skilled in the art will appreciate that other configurations for lighting burner 52 could be employed with air heating system 10 in accordance with its intended use. Examples of such other configurations include electric or pizo-electric spark igniters or automatic lighting devices.

As shown in FIG. 7, multiple heat deflectors 126 are located inside heat transfer housing 100. In one embodiment, two heat deflectors 126 are utilized. In another embodiment, four heat deflectors 126 are used. In this embodiment, a heat deflector 126 is positioned to concentrate the heat as well as to serve as an insulator for sidewalls walls of housing portion 108. It will be appreciated that various other numbers of heat deflectors 126 may be used to carry out the function thereof. Heat deflectors 126 include a first end 127 connected to the inner surfaces of front and back sides 108A and 108B, respectively, of housing portion 108. Heat deflectors 126 are configured to narrow heat transfer chamber 110 in a direction from burner 52 toward heat transfer tubes 120, thereby concentrating the heat produced by burner 52 to an area proximate heat transfer tubes 120. In one embodiment, heat deflectors 126 are composed of spring steel, but it will be appreciated that heat deflectors 126 could be constructed from various other suitable materials known in the art. In addition to directing the heat toward heat transfer tubes 120, heat deflectors 126 also serve as a heat insulator that prevents at least a portion of the heat produced by burner 52 from reaching front and rear sides 108A and 108B of housing portion 108, respectively, thereby keeping the surface of housing portion 108 cooler during operation of air heating system 10. Heat deflectors 126 thereby increase the safety of the air heating system 10 device by reflecting the heat produced by burner 52 away from housing portion 108 so that housing portion 108 is not the primary point of heat contact.

Figure 8:
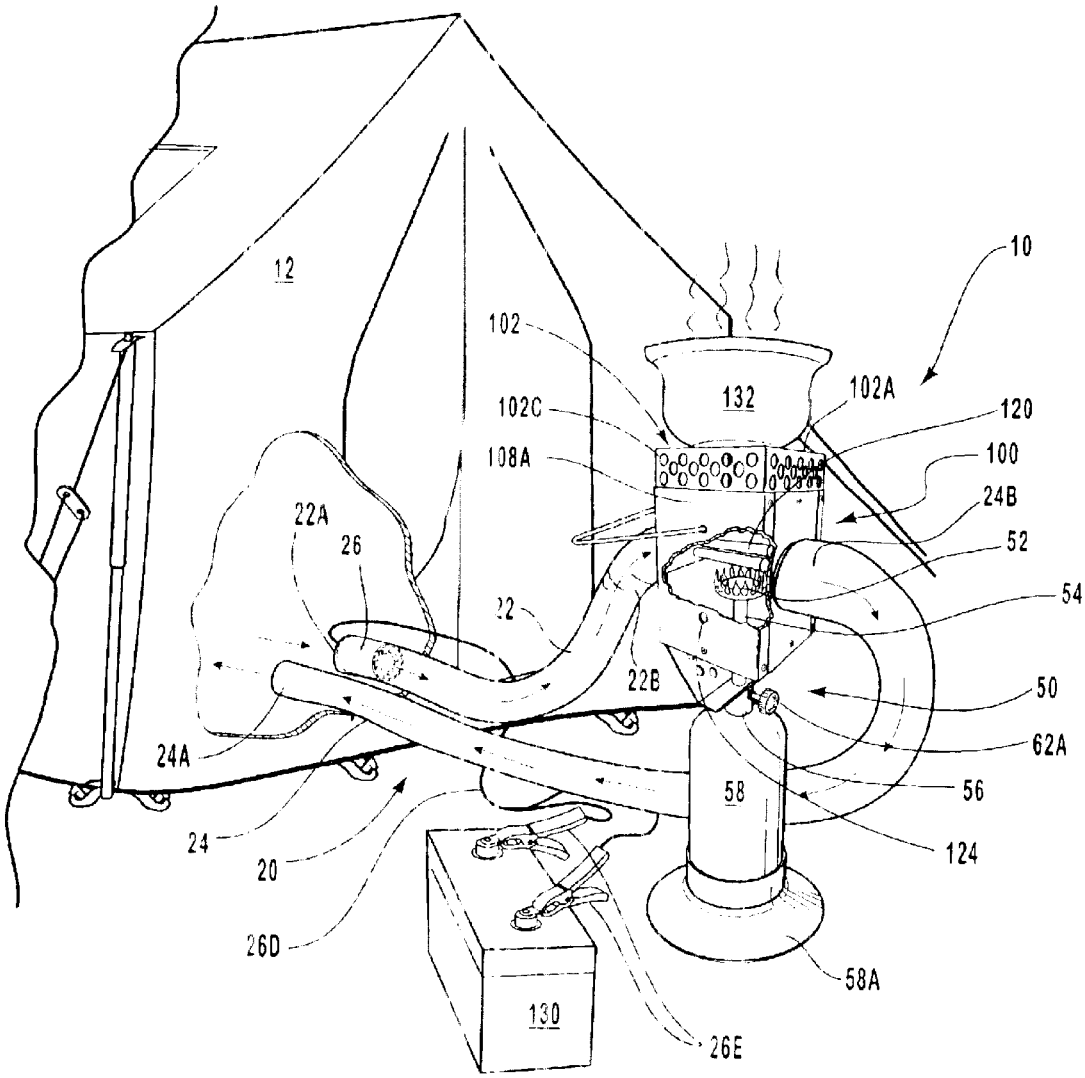
FIG. 8 is a perspective partial cutaway view of one embodiment of a portable air heating system depicting another arrangement for use of the heating system.

Turning now to FIG. 8, which depicts portable air heating system 10 in partial cutaway view and set up in another possible configuration for use in conjunction with tent 12. When in operation, air heating system 10 produces a continuous supply of heated air to tent 12 in the manner described below. Desirably, the air heated by air heating system 10 is free of significant concentrations of harmful and potentially dangerous exhaust gases, and is therefore suitable for use in enclosed structures, such as tent 12.

The following discussion relates to operation of air heating system 10. It will be appreciated that while the discussion is referencing FIG. 8, it is also generally applicable to FIG. 1 and the overall operation of air heating system 10. As shown in FIG. 8, connector 56 of portable air heating system 10 is connected to (typically by inter-engaging threads) the top of fuel source 58. Needle 60 (FIGS. 4–7) of connector 56 is, by this arrangement, disposed a short distance within fuel source 58 to enable a flow of fuel to be initiated when operation of portable air heating system 10 is begun. Fuel source 58 is preferably fitted with a base 58A for providing stability to fuel source 58. Thus, air heating system 10 is disposed stably in a vertical orientation a short distance above the ground.

As seen from FIG. 8, air intake conduit 22 is removably connected at its second end 22B to heat transfer housing 100. In this particular arrangement or usage of portable air heating system 10, first end 22A of air intake conduit 22 is disposed inside tent 12. Second end 24B of air outlet conduit 24 is removably connected to heat transfer housing 100, while first end 24A thereof is also disposed within tent 12. In some circumstances, this configuration of the air conduits 22 and 24 is desirable if maximum heating of tent 12 is desired. Alternatively, end 22A of air intake conduit 22 may be disposed outside of tent 12 to maximize the amount of fresh, ambient air being introduced to portable air heating system 10, as shown in FIG. 1.

To initiate a flow of heated air to a desired location, a user initially turns on motorized fan 26 by electrically connecting electrical cable leads 26D to an appropriate power source, for example, to a 12-volt car battery 130 via clamps 26E as illustrated in FIG. 8. Alternative power sources include, by way of example and not by limitation, a rechargeable battery pack, a generator, or various other sizes of batteries, such as a 6-volt battery. The operation of motorized fan 26 draws a flow of air into first end 22A of air intake conduit 22, through air intake sleeve 112 (not shown), and into heat transfer tubes 120 in heat transfer housing 100. The air then exits heat transfer housing 100 via outlet sleeve 114 (not shown) and passes through air outlet conduit 24, exiting at first end 24A thereof and into tent 12.

Once motorized fan 26 is turned on, the user ignites the fuel at burner 52 by opening fuel valve 62 of connector 56 via knob 62A. The opening of valve 62 causes fuel from fuel source 58 to pass through needle 60 (not shown) and into fuel burner assembly 50 where it is mixed with air. A match or similar flame source is then introduced at burner 52 through burner access hole 124 to ignite the fuel. Lighting the fuel begins a sustained combustion at the surface of burner 52 and creates a large quantity of heat that is transmitted via radiation and convection in a generally upward direction. The heat is concentrated by heat deflectors 126 (not shown) toward heat transfer tubes 120, which are arranged in one embodiment to maximize heat transfer from the combustion to the heat transfer tubes 120.

Heat transfer tubes 120, comprising a thermally conductive material such as by way of example and not limitation, copper, readily absorb the radiated heat and transmit the heat to the air flowing therethrough. The heated air continuously flows into tent 12 via air outlet conduit 24, thereby heating the interior of tent 12. If portable air heating system 10 is used according to the configuration shown in FIG. 8, warm air existing in tent 12 is then recirculated into portable air heating system 10 via air intake conduit 22 and heated again before flowing back into tent 12. In this way, air heating system 10 is able to take advantage of previously heated air in tent 12, thereby providing even more warmth for the user.

Alternatively, first end 22A of intake conduit 22 may be disposed exterior to tent 12 as illustrated in FIG. 1, taking care not to place it near heat transfer housing 100 where harmful exhaust gases may be present, to introduce ambient outside air into air heating system 10. The user may also vary the rate of combustion at burner 52, and hence the rate at which air heating system 10 heats air, by varying the flow of fuel through valve 62 via an adjustment to knob 62A. It will be appreciated that an optional speed control may be added to motorized fan 26 to control the flow of air flowing through air heating system 10.

After transmitting a significant portion of its heat to heat transfer tubes 120, the remaining heat and exhaust gases produced by burner 52 continue to rise past heat transfer tubes 120 to top surface 102A. This remaining heat and exhaust gases heat top surface 102A, then safely exit into the atmosphere via openings 102C in top surface 102A or via the vent openings 102C disposed on sides 102B of first end portion 102. Heated top surface 102A may be used as a heating surface for such things as food or water placed in a container 132. Portable air heating system 10 can be used in adverse weather without the rain or snow from gaining access to the burner because of the configuration of heat transfer housing 100 and particularly surface 102A. Further, because the exhaust gases produced by burner 52 are isolated from air transfer assembly 20 during operation of portable air heating system 10, the heated air flowing through air transfer assembly 20 is free from contamination by the harmful exhaust gases.

In addition to heating an enclosed structure such as a tent, portable air heating system 10 may also be used as a body warmer by directing the flow of heated air from air outlet conduit 24 directly onto a person. It is also understood that burner 52 may be turned off by the user at any time during operation of portable air heating system 10, thereby allowing unheated air to flow through the air transfer assembly 20 and into tent 12.

Figure 9:
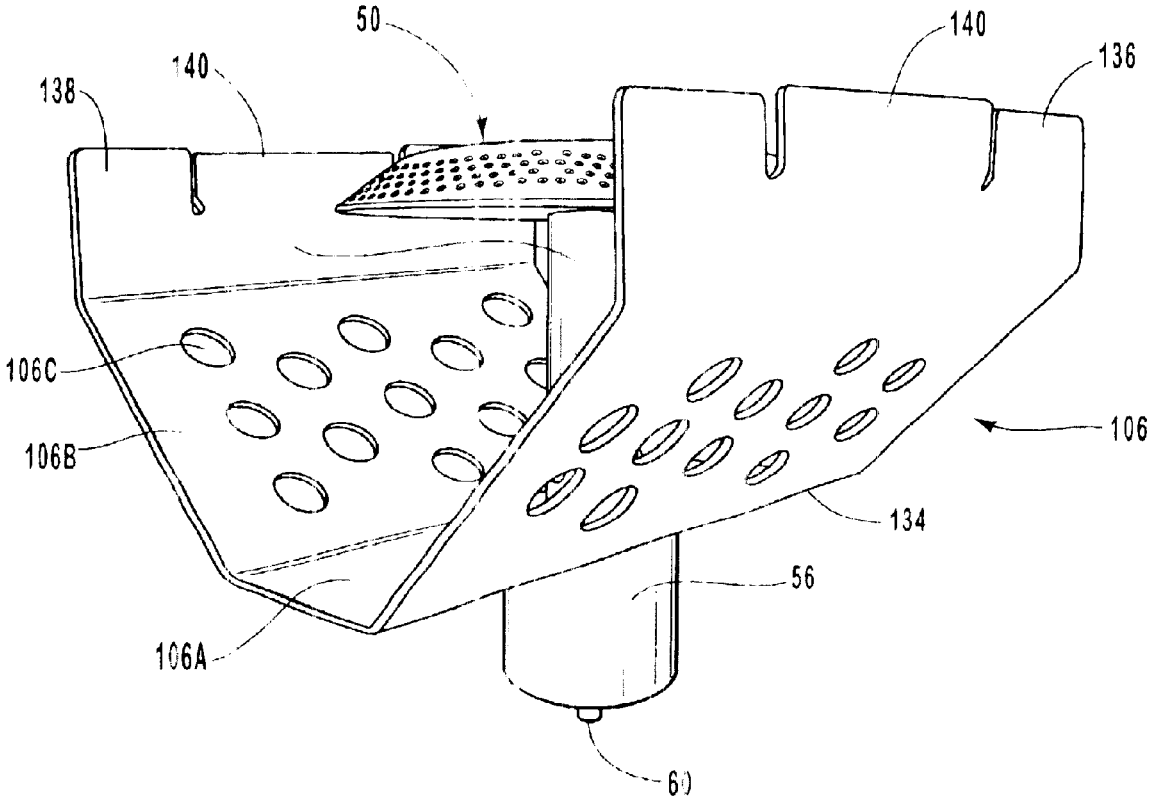
FIG. 9 is a perspective view of another possible embodiment of a burner assembly.

It is appreciated that the details of various features of portable air heating system 10 could be varied while still preserving the same functionality. For example, in an alternative embodiment of portable air heating system 10, second end portion 106 of heat transfer housing 100 is not fixedly attached to middle portion 104, but rather removably attached thereto. An example of such a second end portion 106 is shown in FIG. 9. As can be seen, each angled segment 106B of second end portion 106 comprises a first end 134 adjacent substantially planar segment 106A, and a second end 136 for attachment to middle portion 104 of the housing 100. Second end 136 of angled segment 106B comprises a vertical portion 138 having a segment that forms a notched clip 140 for frictionally engaging the end of middle portion 104 when middle portion 104 and second end portion 106 are joined together. Alternatively, notched clip 140 could be disposed on the end of middle portion 104.

The removability feature of second end portion 106 of heat transfer housing 100 provides expanded utility to portable air heating system 10. For instance, removable second end portion 106 may be separated from air heating system 10 and joined to other components to form a portable stove unit for cooking, or to a portable shower unit to function as a water heater.

The portable air heating system 10 may also include a carrying case (not shown) that allows the device to be easily transported and assembled. The carrying case desirably allows all the components of portable air heating system 10 to be stored when it is not in use. In greater detail, the carrying case preferably includes a recessed handle and a removable lid. The removable lid is preferably releasable attached to a body of the carrying case by two or more hinges that allow the lid to be removed. The removable lid includes a recessed portion or cavity that is sized and configured to receive all or a portion of portable air heating system 10. In one embodiment, the recessed portion is sized and configured to receive and hold one or more pressurized gas cylinders in an upright position. Advantageously, the lid provides a sturdy and stable base for portable air heating system 10, whether or not the lid is attached to the body of the carrying case. A preferred embodiment of the carrying case is disclosed in co-pending U.S. provisional patent application Ser. No. 0/312,550, filed on Aug. 15, 2001, which was converted into a U.S. patent application Ser. No. 10,222,732, filed on Aug. 15, 2002, which is hereby incorporated by reference in its entirety.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A portable air heating system for heating an enclosed area without venting exhaust fumes into the enclosed area, so as to prevent the introduction of dangerous gases into the enclosed area, the portable air heating system comprising:

a fuel burner configured to produce heat as fuel is burned;

an air transfer assembly comprising an air intake conduit, said air intake conduit having one end capable of drawing in air to be heated and delivered to the enclosed area from a location remote from the exhaust gases produced by said fuel burner, said end of said air intake conduit being movable relative to said fuel burner so as to prevent the introduction of any exhaust gases into the enclosed area, said air transfer assembly being configured to release the air at a desired location of the enclosed area; and at least one heat transfer member fluidly connected to said air transfer assembly, each of said at least one heat transfer member being configured to transfer the heat produced by said fuel burner to the air flowing through said at least one heat transfer member, each of said at least one heat transfer member and said air transfer assembly isolating the air being heated and delivered to the enclosed area from the exhaust gases produced by said fuel burner.

2. The portable air heating system of claim 1, wherein said at least one heat transfer member is made of a heat conductive material.

3. The portable air heating system of claim 2, wherein said at least one heat transfer member is made of copper.

4. The portable air heating system of claim 1, wherein said air transfer assembly comprises a fan to draw air from a location remote from the exhaust gases produced by from said fuel burner and releasing the air at a desired location.

5. The portable air heating system of claim 1, wherein said air transfer assembly comprises an outlet conduit capable of releasing the heated air at a desired location.

6. The portable air heating system of claim 1, wherein said air transfer assembly comprises a fan attached to said air intake conduit.

7. The portable air heating system of claim 5, wherein the inside surface of said air outlet conduit comprise a heat reflective material to reduce heat loss from said air outlet conduit.

8. The portable air heating system of claim 5, wherein the air intake conduit and the air outlet conduit are capable of assuming an extended configuration and a substantially collapsed configuration.

9. The portable air heating system of claim 1, further comprising a fuel source connected to said burner.

10. A portable air heating system for heating an enclosed area without venting exhaust fumes into the enclosed area, so as to prevent the introduction of dangerous gases into the enclosed area, the portable air heating system comprising:

a fuel burner configured to produce heat as fuel is burned;

an air transfer assembly comprising an air intake conduit, said air intake conduit having one end capable of drawing in air to be heated and delivered to the enclosed area from a location remote from the exhaust gases produced by said fuel burner, said end of said air intake conduit being movable relative to said fuel burner so as to prevent the introduction of any exhaust gases into the enclosed area, said air transfer assembly being configured to release the air at a desired location of the enclosed area; and isolating means for isolating the air flowing there through from exhaust fumes created by said burner assembly, said isolating means being fluidly connected to said air intake conduit, said isolating means being configured to transfer the heat produced by said fuel burner to air flowing through said isolating means.

11. The portable air heating system of claim 10, wherein said isolating means comprises a heat transfer housing fluidly connected to said air transfer assembly.

12. The portable air heating system of claim 11, wherein said heat transfer housing comprises a plurality of heat transfer members attached to said air transfer assembly, said plurality of heat transfer members being configured to transfer the heat produced by said fuel burner to the air flowing through said plurality of said transfer members, said plurality of heat transfer members being configured to isolate the air being heated therein from the exhaust gases produced by said fuel burner.

13. The portable air heating system of claim 12, wherein each of said plurality of heat transfer members comprises a heat conductive material.

14. The portable air heating system of claim 10, wherein said air transfer assembly comprises an outlet conduit capable of-releasing the heated air at a desired location.

15. The portable air heating system of claim 14, wherein said air transfer assembly comprises a fan disposed within said air intake conduit.

16. A portable air heating system for heating an enclosed area without venting exhaust fumes into the enclosed area, so as to prevent the introduction of dangerous gases into the enclosed area, the portable air heating system comprising:

a fuel burner configured to produce heat as fuel is burned;

an air transfer assembly capable of drawing in air to be heated and delivered to the enclosed area from a location remote from the exhaust gases produced by said fuel burner and releasing the air at a desired location of the enclosed area, said air transfer assembly comprising an air intake conduit having one end which is movable relative to said fuel burner such that air can be drawn in from the location remote from the exhaust gases produced by said fuel burner so as to prevent the introduction of any exhaust gasses into the enclosed are;

a heat transfer housing comprising a housing portion and at least one heat transfer member, said housing portion forming an enclosure around said fuel burner, said at least one heat transfer member disposed within said housing portion and being fluidly connected to said air transfer assembly so as to provide a path through said housing portion in which the air flowing there through is isolated from the exhaust gases produced by said fuel burner, each of said at least one heat transfer member being configured to transfer the heat produced by said fuel burner to air flowing through said at least one heat transfer member.

17. The portable air heating system of claim 16, wherein said heat transfer housing further comprises at least one heat deflector proximate to said at least one heat transfer member.

18. The portable air heating system of claim 17, wherein said at least one heat deflector focuses the heat from said burner around said at least one heat transfer member.

19. The portable air heating system of claim 16, wherein said burner is connected to a fuel source which supports said heat transfer housing in the generally upright position when the portable air heating system is in use.

20. The portable air heating system of claim 16, wherein said at least one heat transfer member comprises a tube.

21. The portable air heating system of claim 20, wherein said tube comprises a heat conductive material.

22. The portable air heating system of claim 16, wherein the housing portion further comprises a top surface that is substantially planar such that objects may be placed thereon to be heated.

23. The portable air heating system of claim 16, wherein said air transfer assembly comprises:

an air intake conduit capable of drawing air from a location remote from the exhaust gases produced by said fuel burner, said air intake conduit is attached to a first end of said at least one heat transfer member; and an outlet conduit capable of releasing the heated air at a desired location, said outlet conduit is attached to a second opposing end of said at least one heat transfer member.

24. A portable air heating system for heating an enclosed area without venting exhaust fumes into the enclosed area, so as to prevent the introduction of dangerous gases into the enclosed area, the portable air heating system comprising:

a fuel burner configured to produce heat as fuel is burned;

an air transfer assembly comprising an air intake conduit capable of drawing in air to be heated and delivered to the enclosed area from a location remote from the exhaust gases produced by said fuel burner and an air outlet conduit configured to release the heated air at a desired location of the enclosed area, said air intake conduit having one end which is movable relative to said fuel burner such that air can be drawn in from the location remote from the exhaust gases produced by said fuel burner so as to prevent the introduction of any exhaust gases into the enclosed area;

a heat transfer housing comprising a housing portion and at least one heat transfer tube, said heat transfer housing forming an enclosure around said fuel burner, said at least one heat transfer tube being disposed within said housing portion and being fluidly connected to said air transfer assembly so as to provide a path through said heat transfer housing in which the air flowing there through is isolated from the exhaust gases produced by said fuel burner, each of said at least one heat transfer member being configured to transfer the heat produced by said fuel burner assembly to air flowing through said at least one heat transfer member, wherein each of said at least one heat transfer member, said air intake conduit and said air outlet conduit are in fluid communication.

25. The portable air heating system of claim 24, wherein said air transfer assembly comprises a fan disposed within said air conduit.

26. The portable air heating system of claim 24, wherein said air intake conduit and said air outlet conduit are capable of assuming a collapsed and an extended configuration.

27. A portable air heating system for heating an enclosed area without venting exhaust fumes into the enclosed area, so as to prevent the introduction of dangerous gases into the enclosed area, the portable air heating system comprising:

a fuel burner configured to produce heat as fuel is burned;

an air transfer assembly comprising an air intake conduit, said air intake conduit having one end capable of drawing in air to be heated and delivered to the enclosed area from a location remote from the exhaust gases produced by said fuel burner so as to prevent the introduction of any exhaust gases into the enclosed area, said air transfer assembly being configured to release the air at a desired location of the enclosed area; and at least one heat transfer member fluidly connected to said air transfer assembly, each of said at least one heat transfer member being configured to transfer the heat produced by said fuel burner to the air flowing through said at least one heat transfer member, each of said at least one heat transfer member and said air transfer assembly isolating the air being heated and delivered to the enclosed area from the exhaust gases produced by said fuel burner.

* * * * *

UNITED STATES PATENT AND TRADEMARK OFFICE

CERTIFICATE OF CORRECTION

PATENT NO. : 6,941,677 B2
APPLICATION NO. : 10/215918
DATED : September 13, 2005
INVENTOR(S) : Trevor Adrian It is certified that error appears in the above-identified patent and that said Letters Patent is hereby corrected as shown below:

Title Page,
Item (57), under "ABSTRACT", line 2, after "stream" insert --of--

Column 1,
Line 35, change "modem" to --modern--
Line 64, change "bum" to --burn--

Column 2,
Line 4, change "bum" to --burn--

Column 4,
Line 17, after "one embodiment" insert --of--

Column 5,
Line 62, after "ambient air" insert --or previously heated air--

Column 6,
Line 31, change "appreciate" to --appreciated--
Line 40, after "system 10" remove [,]

Column 10,
Line 15, change "know" to --known--
Line 30, after "each" insert --of--

Column 12,
Line 9, change "pizo-electric" to --piezo-electric--

Column 14,
Line 50, change "releasable" to --releasably--
Line 62, change "0/312,550," to --60/312,550,--
Line 64, change "10,222,732" to --10/222,732--

UNITED STATES PATENT AND TRADEMARK OFFICE

CERTIFICATE OF CORRECTION

PATENT NO. : 6,941,677 B2
APPLICATION NO. : 10/215918
DATED : September 13, 2005
INVENTOR(S) : Trevor Adrian It is certified that error appears in the above-identified patent and that said Letters Patent is hereby corrected as shown below:

Column 16,
Line 47, change "are;" to --area;--

Signed and Sealed this

Thirteenth Day of March, 2007

JON W. DUDAS
*Director of the United States Patent and Trademark Office*